United States Patent [19]

Chagnot

[11] Patent Number: 4,856,280

[45] Date of Patent: Aug. 15, 1989

[54] APPARATUS AND METHOD FOR THE SPEED OR POWER CONTROL OF STIRLING TYPE MACHINES

[75] Inventor: Bruce J. Chagnot, Athens, Ohio

[73] Assignee: Stirling Technology, Inc., Athens, Ohio

[21] Appl. No.: 286,607

[22] Filed: Dec. 19, 1988

[51] Int. Cl.[4] ..... F02G 1/04

[52] U.S. Cl. ..... 60/522; 60/520

[58] Field of Search ..... 60/517, 520, 521, 522, 60/518

[56] References Cited

U.S. PATENT DOCUMENTS

| | | | |
|---|---|---|---|
| 3,583,155 | 6/1971 | Schuman | 60/520 |
| 4,179,891 | 12/1979 | Gronvall | 60/521 |
| 4,622,813 | 11/1986 | Mitchell | 60/522 |

*Primary Examiner*—Allen M. Ostrager

*Attorney, Agent, or Firm*—Frank H. Foster

[57] ABSTRACT

The invention comprises both apparatus and an accompanying method for the controlling of the speed, stroke and power output of a Stirling engine. The invention positions a valving arrangement to control the working gas flow within a gas flow passage connecting the hot end and cold end of the displacer cylinder; the valving arrangement is controlled by a suitable engine speed, stroke or power detector.

10 Claims, 2 Drawing Sheets

APPARATUS AND METHOD FOR THE SPEED OR POWER CONTROL OF STIRLING TYPE MACHINES

TECHNICAL FIELD

This invention relates to apparatus and an accompanying method for the continuous control of the speed, stroke or power of a variety of Stirling type machines and more particularly relates to an apparatus and methods which utilize a variable valving arrangement positioned in a working gas flow passage which connects the compression space and the expansion space. The mode of operation involves continuously regulating the working gas flow back and forth within the flow passage manually or in conjunction with a sensing means which detects the machine's operating parameters and controls the valving arrangement to continuously regulate the working gas flow to control speed, stroke or power.

BACKGROUND ART

The increased economic feasibility of utilizing energy from solar energy collectors, concentrators and the like, as well as the burning of inexpensive waste products, has increased the attractiveness of the Stirling engine as a machine for directly converting heat energy to mechanical energy.

The Stirling cycle engine has been known for decades and relies upon the pressure variations of a mass of working fluid confined in a work space. These pressure variations are caused by the alternating heating and cooling of the working fluid which is forced by the motion of pistons between communicating expansion (hot) space and compression (cold) space portions of the work space.

A particular problem with Stirling engines is that when they are unloaded or underloaded the engine may overspeed, resulting in immediate damage to the engine as well as a shortened engine life. Since there is a very large thermal inertia associated with the heater, it is not possible to respond to quick changes in the external load by simply controlling the burn rate of the fuel.

The prior art has utilized a variety of methods to try to enhance the Stirling engine's capability to respond to quick changes in the external load. One effective power modulator is an adjustable vent between the compression space and the bounce space. However, this attempted solution requires a normally closed, pressure-type valve.

Another attempt has been to vary the working gas charge pressure which, if done rapidly, imposes large pressure forces on critical engine components. Such a pressure modulation technique is vulnerable to overspeed at atmospheric pressure even if all of the charge pressure is relieved A further disadvantage is the long charge pressure recovery time, so that full power may not be reached again for up to about ten minutes.

U.S. Pat. No. 3,724,206 discloses a speed control regulator for a closed-cycle displacer-type hot gas engine comprising a separate heating device situated between the regenerating device and the hot end of the displacer cylinder, a passageway bypassing the heating device by leading directly from the regenerating device into the hot end of the displacer cylinder, an externally controlled variable valve which determines what portion of the working gas, if any, will bypass the heating device when being transferred into the hot end of the displacer cylinder, and non-variable valves which allow all of the working gas to bypass the heating device when being transferred out of the hot end of the displacer cylinder.

Another system has been a valve-controlled vent to a separate reservoir to decrease engine efficiency and therefore decrease engine power. U.S. Pat. No. 3,756,018 discloses means for varying the mean pressure of the gaseous working medium in a multiple chamber reservoir at a higher temperature position in each engine cylinder connected to the lower temperature portion of the engine cylinder with valve regulating means governing the following of pressures of gas in the various stages and the cooler portion of the engine cylinder.

U.S. Pat. No. 2,547,781 discloses a hot gas engine with a working chamber, a control system comprising a distinct chamber, and means, including a variable flow resistant circulation aperture open at all times for coupling the distinct chamber to the working chamber, valve means for varying the flow resistant circulation aperture, and actuating means for operating the valve means, the actuating means being responsive to the speed of the engine.

U.S. Pat. Nos. 228,716; 1,895,082; 3,220,178; 4,019,322; and 4,622,813 are also related examples involving the valve engine art.

Accordingly, it is an object of the present invention to provide an improved class of Stirling machines which can quickly, simply, and efficiently have its operation controlled. It is another object of the present invention to provide a Stirling machine which can easily and effectively tune the output of the machine to match the load requirement.

It is yet another object of the invention to provide a variable damper valve which is located in the heat exchanger loop of the machine for restricting flow therein to reduce heat transfer and power capability, and for causing flow losses in the heat exchanger loop to reduce available power.

Upon further study of the specification and appended claims, further objects and advantages of this invention will become apparent to those skilled in the art.

BRIEF DISCLOSURE OF INVENTION

This invention relates to a control damper mechanism for a variety of Stirling machines which can continuously control the operation of the machine in a particularly effective manner. Stirling machines contain both an expansion and a compression space which are connected by a flow passage, which usually contains a heater, a regenerator and a cooler. The motion of the pistons of the machine forces gas to oscillate back and forth through this connecting passage.

The invention involves effectively positioning in the working gas flow passage a variable valving arrangement, such as a rotatable damper ring which has multiple slots and an open fluid conduit arrangement so as to form a one to one correspondence with a variety of separate, smaller flow sections which in the preferred embodiment comprise the working gas flow passage. This resulting valve arrangement regulates the oscillating working gas flow by varying the available flow area, and its movements and resulting arrangements are controlled by feedback from an engine speed, stroke or power detector. The detector continuously controls the flow resistance of the valve arrangement in correspondence with the machine's operating parameters so as to reduce excessive speed, stroke or power. Flow resistance is increased to reduce power. In such a fashion, the resulting damping system operates to ensure that the machine never exceeds an unsafe or undesirable speed, stroke or power.

Figure 1:
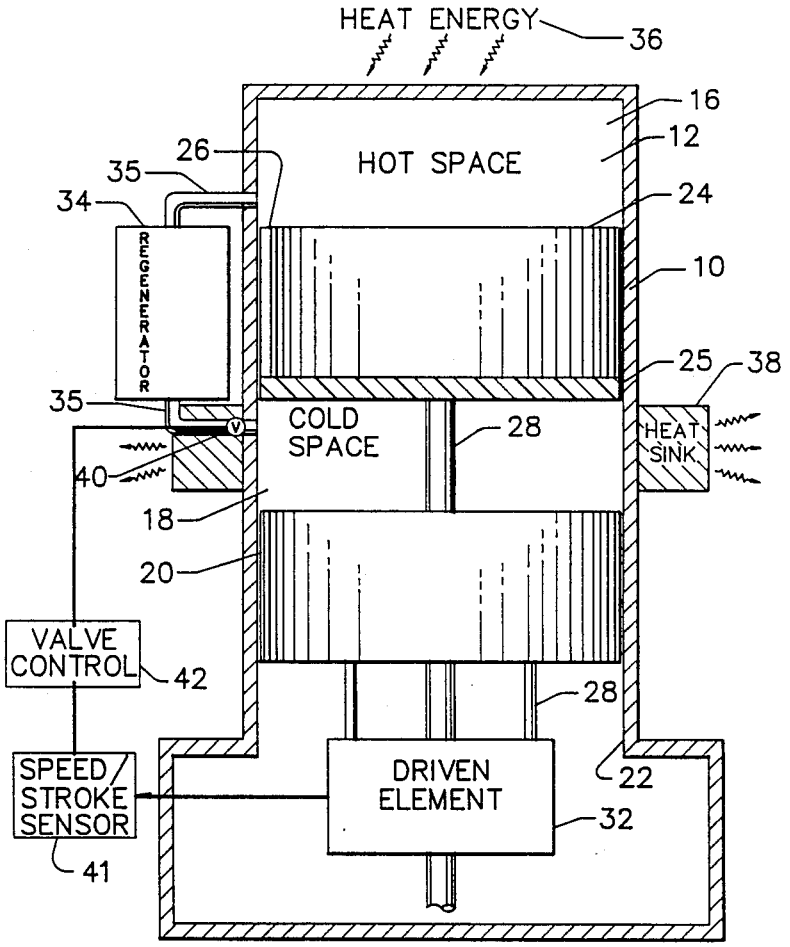
FIG. 1 is a diagrammatic view of a free piston Stirling engine suitable for utilizing the damping valve system of the present invention which controls flow through the hot space-regenerator-cold space internal engine passage.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

DETAILED DESCRIPTION

It is initially to be emphasized that the particular power control device disclosed herein is applicable to all types of Stirling machines, either engines or coolers, including crank, free piston, Ringbom, multi-cylinder and the like. Thus, the particular embodiments shown in the figures are to be viewed as merely exemplary.

FIG. 1 illustrates a simplified diagram of a Stirling type engine having a housing 10 enclosing a work space 12. The work space 12 is subdivided further into an expansion space 16 and a compression space 18. These spaces are filled or charged with a pressurized gas, such as air or hydrogen, which is suitable for use in a Stirling machine. A power piston 20 is reciprocally mounted in a power piston cylinder 22. A displacer 24, having a relatively small mass but a substantial volume and having a seal 25, is reciprocally slidable in a displacer cylinder 26 formed in the work space 12.

A displacer rod 28 engages the displacer 24 and extends axially and slidably through bearing 30 which is formed axially through the power piston 20. The power piston 20 is connected by a suitable mechanical linkage 28 to a driven element 32.

The expansion space 16 and a compression space 18 are connected together through a working gas flow passage which usually includes a regenerator 34, conducting passageway 35, and a variable valve 40 to form an external heat exchanger loop.

The machine of FIG. 1 is operated as an engine or motor by the application of heat from a heat source 36 to the associated expansion space 16 and the removal of heat from the cold space by means of a heat exchanger or heat sink 38.

The invention particularly relates to a fast acting and reacting variable valve or damper means shown schematically at 40 in FIG. 1, which is effectively positioned to control gas flow within the external heat exchanger loop, that is the passageway traversed by the working gas which connects expansion space 16 to compression space 18 through regenerator 34. A preferred embodiment of a suitable damper means is set forth in FIGS. 2 and 3. Through such a mechanism, one can increase the flow resistance in the heat exchanger loop and thereby reduce the gas heat transfer and also cause flow losses. The result is a reduction of power. The valve can be manually operated for simple, manual power modulation.

The result in a kinematic engine of a reduced or insufficient demand for power by the load is an increase in operating speed. Thus, one important application of the concepts of the present invention is to prevent such an overspeed in an engine by sensing engine speed and increasing the flow resistance in response to increases of speed above a selected maximum limit.

Under normal engine operating conditions of the preferred embodiment, the damper mechanism is not actuated, so working gas flow is completely unimpeded and can flow back and forth through the heat exchanger loop. Flow losses in the heater-regenerator-cooler loop are kept to a minimum. However, when an overspeed condition arises, it is detected by a suitable speed sensor commonly available to one skilled in the art and the damper is activated; consequently, the engine is restrained before it exceeds an undesirable and potentially damaging speed.

Speed, ordinarily in revolutions per unit of time, may be detected by any of the variety of such tachometer-type devices currently available on the market. The output from the speed sensor 41 is simply applied to the valve control means 42 to increase the flow resistance in response to increased speed above a selected limit. Preferably, the flow resistance is increased as a continuous function of increased speed or stroke and is decreased as a continuous function of decreased speed or stroke.

Figure 2:
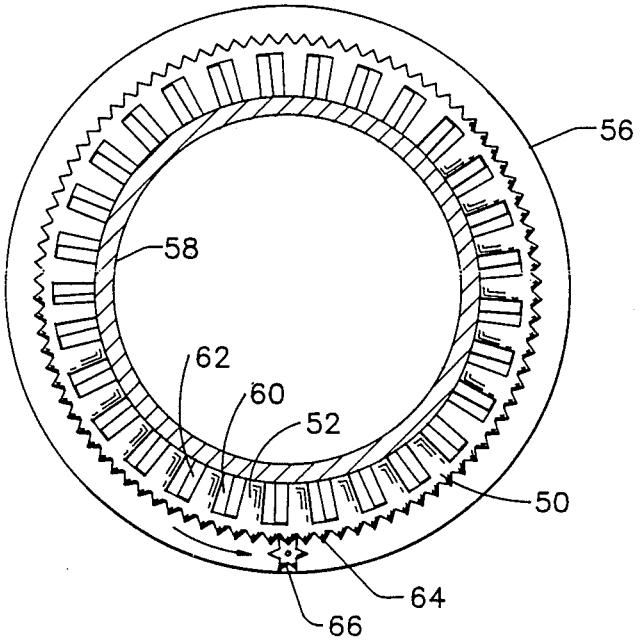
FIG. 2 is a cross-sectional view of the damper ring centered within a section of the working gas flow passageway where it can either obstruct or permit the passage of gas.
Figure 3:
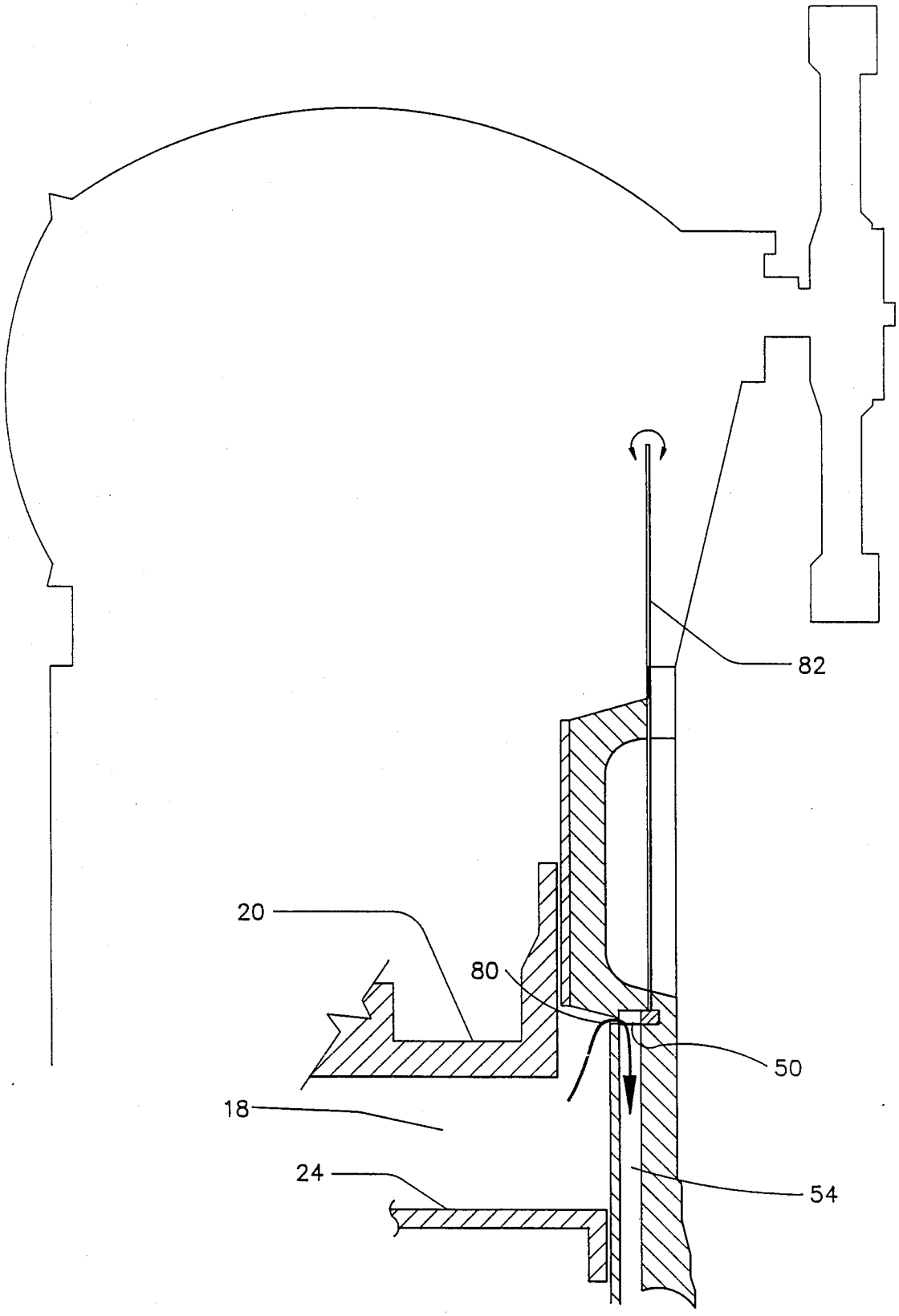
FIG. 3 discloses a preferred embodiment of the invention involving a preferred location of the slotted ring cold space.

FIGS. 2 and 3 set forth a particularly preferred embodiment of the invention. A valve arrangement, such as that seen at 40 in FIG. 1, comprises a slotted ring 50 containing a plurality of equally circumferentially spaced damper flutes 52. The ring 50 is positioned coaxially in a working gas fluid passage 54 inside the cooler casting 56 and outside of inner circumferential surface 58. The flute structure is designed so that the damper flutes 52 form a corresponding one to one relationship with a plurality of cooler passages 60, which are separated from adjacent passage 60 by an equal number of cooler flutes 62 in the flow passage 54.

During normal operation, cooler passages 60 and damper flutes 52 are aligned so that the flutes create no flow obstruction for the fluid passing through the cooler passage 60 in conduit 54 and, thus, no damping of the flow takes place. However, when the engine is operating in an overspeed or overstroke mode, ring 50 is turned through activation of ring gear segment 64 and control pinion 66 by a control sensor (not shown) so that the flutes cover the cooler passages to the degree necessary to obstruct the flow therethrough to the amount desired. Thus, the flow losses will rise and the engine power and speed/stroke will decrease a corresponding amount. Most preferably, the damper ring 50 with flutes 52 and the cooler passages 60 should be designed so that when the damper is completely activated, i.e., completely obstructing each passage 60, the engine will completely stop. The precise rotation of the damper ring is controlled, either manually, or automatically by a suitable speed sensor means such as a fly-ball or an electric shaft rotation speed sensor system known to those skilled in the art.

FIG. 3 discloses a preferred location in which to position the damper ring. The ring 50 is positioned so as to obstruct the fluid passage 54 at the cold space 18 and the compression port 80, which is the coolest point of the internal engine flow cycle. The power piston 20 and the displacer 24 each define the compression space 18 which is adjacent to port 80. The damper ring 50 is controlled by the movements of control 82, which is connected to a suitable internal or external speed sensor (not shown) to form a governor.

In addition to its mode of preventing overspeed, the present invention may also be used as a governor in a conventional feedback loop. For example, the valve may be constructed to have an intermediate valve of flow resistance for the working gas through the flow passage. The flow resistance is selected for a normal, nominal load. A suitable speed detecting mechanism such as the fly-ball mechanism of a fly-ball governor or an electronic speed detector can be linked or connected to the valve and set to a desired set point speed at which an equilibrium condition is established between the intermediate flow resistance and the power demanded by the load. Increases in speed result in further restriction, and thus an increase in the flow resistance of the valve, while decreases in speed have the opposite effect.

While certain preferred embodiments of the present invention have been disclosed in detail, it is to be understood that various modifications may be adopted without departing from the spirit of the invention or scope of the following claims.

I claim:

1. Apparatus for controlling power of a Stirling type machine having separate expansion and compression spaces connected by a flow passage through which the working gas passes, wherein the improvement comprises, a variable valving arrangement positioned in the working gas flow passage for continuously regulating the flow resistance of the working gas flow passage during machine operation; and sensing means for controlling the valving arrangement to increase the flow resistance in response to increases of operating speed beyond selected operating limits.

2. Apparatus for controlling power of a Stirling type machine having separate expansion and compression spaces connected by a flow passage through which the working gas passes, wherein the improvement comprises, a variable valving arrangement positioned in the working gas flow passage for continuously regulating the flow resistance of the working gas flow passage during machine operation; and sensing means for controlling the valving arrangement to increase the flow resistance in response to increases of operating stroke beyond selected operating limits.

3. Apparatus according to claim 1 or claim 2 wherein the valving arrangement comprises a rotatable damper ring having a plurality of spaced ports seating against a circular seat having a plurality of matingly arranged spaced ports for varying the overlapping registration of the ports.

4. Apparatus according to claim 3 wherein the damper ring is connected to a rod which is adapted to rotate the ring and vary the flow resistance of the working gas flow passage in response to machine operating parameters.

5. Apparatus according to claim 1 wherein the engine sensing means is a fly-ball governor mechanism for detecting engine speed.

6. A method for controlling the output power from a Stirling engine of the type having an expansion space and a compression space containing a working gas and connected together through a working gas flow passage usually including a regenerator, the method comprising reducing the power by continuously increasing the flow resistance through said flow passage.

7. A method in accordance with claim 6 further comprising sensing engine speed and increasing the flow resistance in response to increased speed above a selected limit.

8. A method in accordance with claim 6 further comprising sensing engine stroke and increasing the flow resistance in response to increased stroke above a selected limit.

9. A method in accordance with claim 6 wherein the flow resistance is increased as a continuous function of increased speed, stroke or power and decreased as a continuous function of decreased speed, stroke or power.

10. A method for controlling the power from a Stirling machine of the type having an expansion space and a compression space containing a working gas and connected together through a working gas flow passage usually including a regenerator, the method comprising modulating output by increasing the flow resistance through said flow passage to decrease output and decreasing said flow resistance to increase output.

* * * * *